United States Patent [19]

Dalebout et al.

[11] Patent Number: 5,062,632

[45] Date of Patent: Nov. 5, 1991

[54] USER PROGRAMMABLE EXERCISE MACHINE

[75] Inventors: William T. Dalebout; Michael Burk, both of Logan, Utah

[73] Assignee: Proform Fitness Products, Inc., Logan, Utah

[21] Appl. No.: 455,631

[22] Filed: Dec. 22, 1989

[51] Int. Cl.[5] ..... A63B 21/005

[52] U.S. Cl. ..... 272/129; 272/69; 272/DIG. 4; 272/DIG. 5; 272/DIG. 6; 434/247

[58] Field of Search ..... 272/69, 70, 72, 73, 272/129, DIG. 4–6; 434/247, 392; 128/25 R; 73/379

[56] References Cited

U.S. PATENT DOCUMENTS 4,358,105 11/1982 Sweeney, Jr. ..... 272/73
4,504,968 3/1985 Kaneko et al. ..... 381/103
4,708,337 11/1987 Shyu ..... 272/69
4,714,244 12/1987 Kolomayets et al. ..... 272/133

*Primary Examiner*—Richard J. Apley
*Assistant Examiner*—Joe H. Cheng
*Attorney, Agent, or Firm*—Trask, Britt & Rossa

[57] ABSTRACT

An exercise apparatus with a control mechanism is disclosed. The control mechanism is linked to a bank of horizontally arranged slide potentiometers, which act as user-movable indicators. The user can move these indicators up and down to indicate an ordered set of relative difficulty values. The exercise apparatus, such as a treadmill, is provided with a control mechanism to control the difficulty of the exercise engaged by the user on the exercise apparatus in relative difficulties corresponding to the ordered set of relative values selected. The exercise apparatus is adapted to engage in this ordered set during a chronological set of program steps.

14 Claims, 8 Drawing Sheets

USER PROGRAMMABLE EXERCISE MACHINE

BACKGROUND OF THE INVENTION

1. Field

The present invention is directed to an exercise machine that accepts and operates on a user-selected program for an exercise routine.

2. State of the Art

Stationary exercise machines are popular and widely used. They allow persons to engage in beneficial physical exercise while conveniently remaining at home or in a gym. Such exercise machines include, for example, treadmills, exercise cycles, and rowing machines. The user exercises by performing work upon the machine. Work is defined as force multiplied by distance. The work requirement or "difficulty" of exercise engaged in can be adjusted by changing the level of resistance offered by the device or by increasing the distance over which the user performs the exercising motion. It is widely recognized that a person can obtain beneficial results by varying the difficulty of the exercise during each exercise session and between sessions. For this reason, exercise machines are commonly equipped with mechanisms for manually adjusting the level of difficulty of the exercises engaged in.

Treadmills are unique in that they provide two different forms of difficulty adjustment. Both the incline of the running surface and the speed of the moving track can each be adjusted independently. When the incline is increased, the user is required to lift his legs higher, thus increasing the work output required of the user. As the speed of the track is increased, the user is required to move his feet and body more quickly, thus also increasing the work requirement. Exercise cycles typically include a mechanism for adjusting resistance or force offered against the pedaling motion of the pedals. Rowing machines typically have a mechanism for adjusting the resistance offered to the rowing levers or a rowing bar. As resistance is increased, so is the work requirement and therefore the difficulty of the exercise.

Certain exercise cycles have some form of control mechanism, such as an internal microprocessor, that is programmed to vary the resistance offered to the pedaling mechanism. The program operates according to a routine prescribed by the manufacturer. Certain of such cycles offer a number of such routines from which the user may select. Relative levels of resistance are displayed in some visual form to indicate to the user the relative difficulty currently being experienced.

However, some users of exercise equipment may not be entirely satisfied with the routines prescribed by the manufacturer. They may wish to engage in a sequence of exercise difficulties that they believe will provide an optimum exercise program for the conditioning goals they have in mind.

Many users of exercise equipment feel intimidated by typical computer interface systems, such as alphanumeric keyboards and/or LED or LCD displays. Many persons have a "mental block" against anything related to computers and may be unwilling to overcome this mental block to take the steps necessary to input their desired program into a control system computer.

There remains a need for exercise equipment having a mechanism allowing for easy selection of a user-defined routine or sequence of exercise difficulties. Such an exercise machine would preferably be adapted such that the user can "program" his selected routine into the apparatus without being required to operate typical computer interface systems such as alphanumeric keyboards and displays. Such an exercise apparatus would be particularly useful in the form of a treadmill providing for a programmed routine in which a control system adjusts the speed of the running track and/or the incline of the track according to a user-selected program.

SUMMARY OF THE INVENTION

The present invention provides an exercise apparatus having a frame that provides structural support for other members of the exercise apparatus. A movable member is mechanically associated with the frame and is adapted to be repetitively moved by a user to thereby engage in exercises upon the exercise apparatus. Adjustment means is associated with the movable member and is adapted to selectively vary the difficulty of the exercises. A plurality of user-movable indicators is associated with the frame and positioned with respect to each other to visually indicate an ordered set of relative values. Control means is operatively linked with the movable indicators and the adjustment mechanism. The control means is adapted to selectively control the adjustment means to provide a sequence of steps of difficulties of exercises corresponding in relative amounts to the selected ordered set of relative values.

The exercise apparatus may be, for example, a treadmill, an exercise cycle, a rowing machine, a cross-country skiing simulator, a stepping exerciser, or a weight lifting simulator, etc. The movable member may be a running belt on a treadmill, pedals on an exercise cycle, rowing arms or bar on a rowing machine, or sliding and moving parts of a skiing simulator. The adjustment means may be any mechanism used to resist or increase the difficulty of exercise on the exercise apparatus, and may include, for example, means to adjust the angle of incline of a treadmill or to alter the speed of the moving track, or resistance mechanisms to resist the motion of moveable members of other exercise machines. Such resistance mechanisms may include, for example, friction brakes, hydraulic and/or pneumatic systems, alternators, magnetic devices, etc.

The user-movable indicators may be provided by any device that allows a user to select various relative positions of the indicators to correspond to relative difficulties of exercise that he plans to "program" into the machine. For example, such indicators may be a bank of slide potentiometers arranged horizontally so that the user can move the potentiometers up and down to indicate a corresponding set of relative values. The relative vertical positions of the indicators are indicative of the relative values they represent. Alternatively, the indicators may be visually indicated by light emitting diodes (LED's) or liquid crystal diode (LCD) segments to display, for example, a single illuminated light or a "ribbon" of LCD segments. Such illuminated indicators are "moveable" by means of the user adjusting some type of electronic controller to control the position of the indicator. Such controls may include, for example, rotary potentiometers or membrane switches, etc.

The control means may be provided by any mechanism that is adapted to use these relative values to effect an ordered set of difficulties in an exercise routine. For example, a divider circuit adapted to produce a set of timed steps and linked with other circuitry to control the adjustment means provides a useful such control means. A control means may also be a computer or microprocessor programmed with a set of program steps to effect such a user-selectable routine. As used herein, the word "program" is not restricted to the programming of computers or microprocessors, but is intended to refer to any method by which a user selects a routine of relative values.

The control means may be further adapted to derive a preselected time interval wherein each of the steps lasts the duration of this time interval. The exercise apparatus may further comprise time input means communicatively linked with the control means for receiving a user-selected time period for an exercise session.

In one embodiment, the frame is a treadmill frame and the movable member is a track running on the frame. The adjustment means may include a motor linked with the track and adapted to selectively vary the running speed of the track. Alternatively, the adjustment means may include a powered incline system linked with the frame for selectively altering the incline of the frame. In a preferred embodiment, the adjustment means includes both a speed varying means associated with the track for varying the running speed of the track and an incline varying means associated with the frame for varying the incline of the frame.

Exercise machines of the invention provide a control system that is easily operated by users. The user need merely select a set of relative values on a group of indicators, and the exercise apparatus will use the set of relative values to provide a corresponding selected routine of relative exercise intensities to the user. Thus, users are able to effectively and easily "program in" a selected exercise routine.

BRIEF DESCRIPTION OF THE DRAWINGS

In the drawings, which illustrate what is currently believed to be the preferred embodiment of the invention.

DETAILED DESCRIPTION OF THE ILLUSTRATED EMBODIMENT

Figure 1:
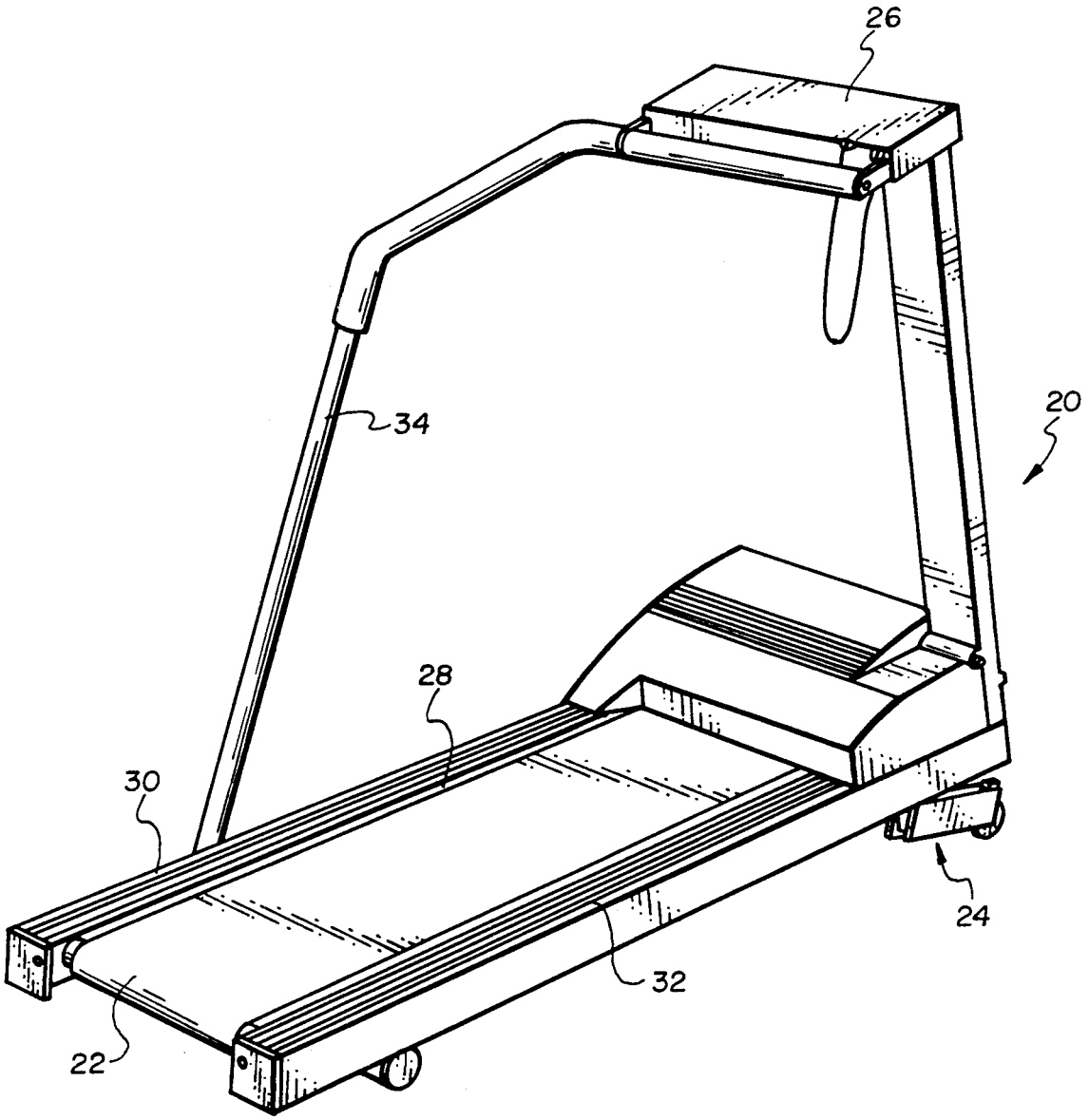
FIG. 1 is a perspective illustration of a treadmill.

Referring to FIG. 1, the illustrated treadmill includes a frame 20, a track or walking belt 22, an adjustable incline system 24, and a control console 26. Frame 20 is part of a walking platform, shown generally at 28 upon which the walking belt 22, which is an endless loop belt, rides. Frame 20 also includes a pair of grip pads 30 and 32, upon which a user can stand when he is not walking on the walking belt 22, and a side rail 34 that the user can grasp to steady himself while standing upon grip pads 30 and 32 or while exercising by walking or running on belt 22. The user operates the exercise apparatus of FIG. 1 by manipulating various components of console 26.

Figure 2:
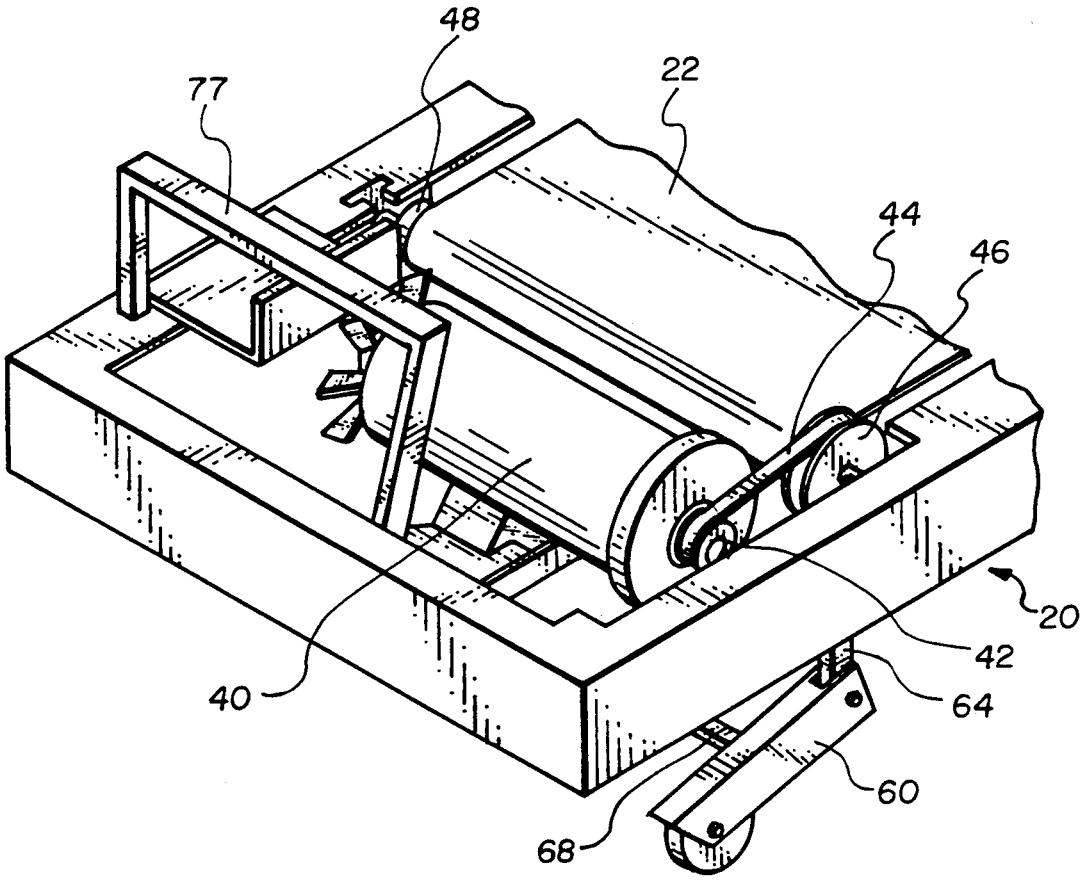
FIG. 2 is a perspective, partial section view of a track and motor assembly.

FIG. 2 illustrates a motor and walking belt assembly of the invention. Electrical motor 40 is mounted to frame 20 to provide power for movement of belt 22. Motor 40 includes a pulley 42 connected to a fan belt 44, which is in turn connected to another pulley 46. Pulley 46 is concentrically mounted on a roller pulley 48, which registers with belt 22. A similar roller pulley is mounted at the bottom or foot end of the treadmill to allow belt 22 to freely rotate in endless loop fashion as powered by motor 40. Motor 40 is electrically connected to electrical components within console 26 as described more completely infra.

Figure 3:
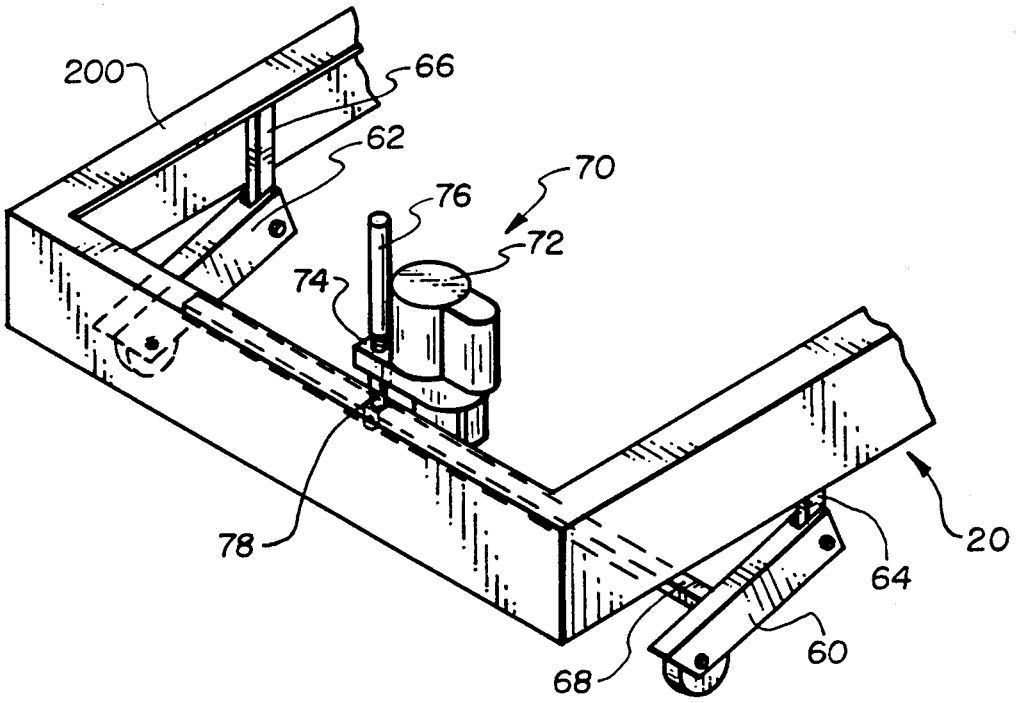
FIG. 3 is a perspective, partial section view of a powered incline system.

FIG. 3 illustrates a powered incline system. A pair of legs 60 and 62 are pivotally mounted at brackets 64 and 66 to frame 20, as shown. A brace 68 connects leg 60 to leg 62. A linear actuating unit, generally indicated at 70 serves as a powered mechanism for raising or lowering the incline of frame 20 with respect to a floor surface. Linear actuator unit 70 includes a motor 72 associated by means of a pinion and spur gear drive to a screwdrive 74, which in turn actuates a piston assembly 76. The top of piston 76 is mounted to bracket 77 (FIG. 2). The bottom of piston assembly 76 is mounted by a bracket 78 to brace 68. Upon selective rotation of motor 72, screwdrive 74 urges the top of piston 76 either away from or toward brace 68, to thereby either raise or lower frame 20 with respect to the floor surface. Motor 72 is a bidirectional motor electrically connected to the control system of FIG. 6.

Figure 4:
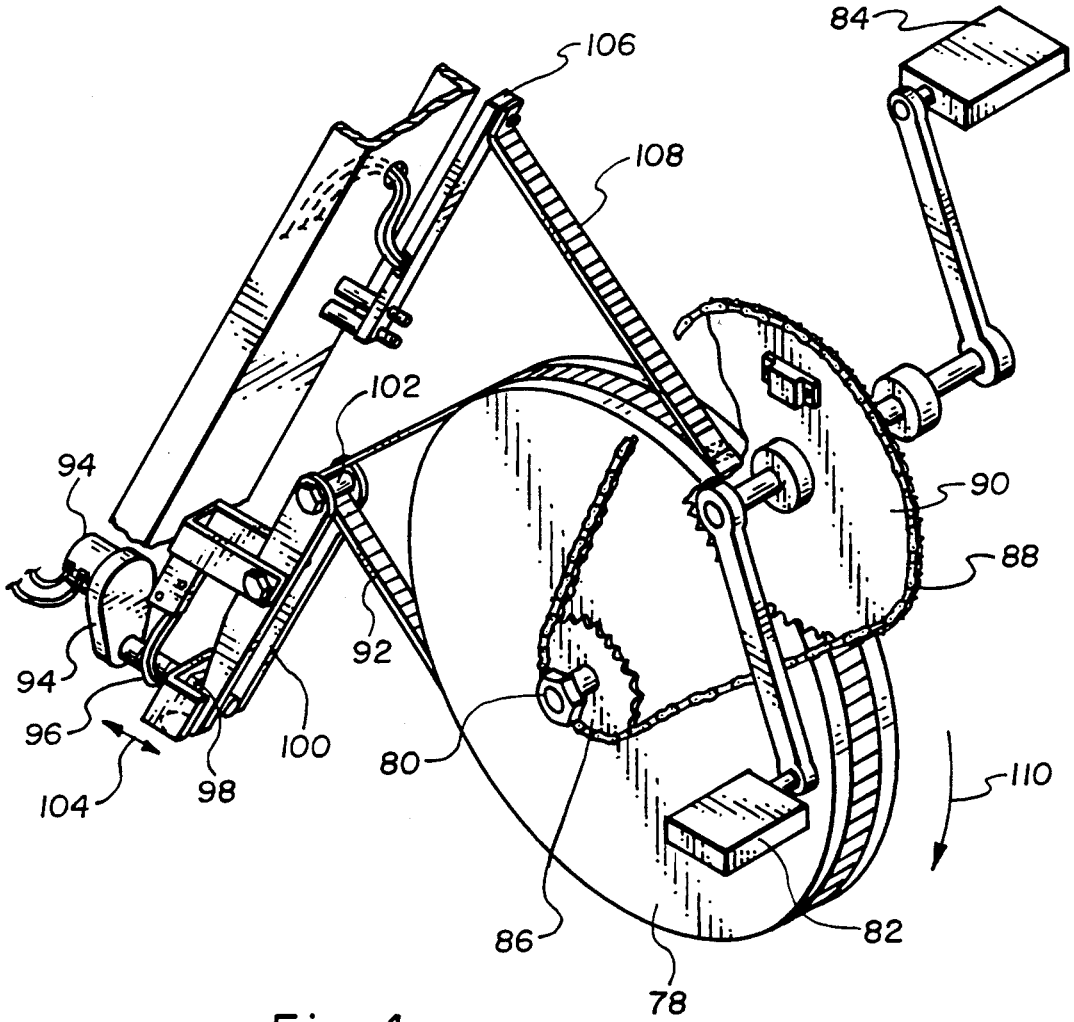
FIG. 4 is a perspective, partial sectional view of a powered resistance mechanism for an exercise cycle.

FIG. 4 represents a powered resistance mechanism for an exercise cycle. A flywheel 79 is rotatably mounted by means of an axle 80 to some portion of the frame of the cycle. Flywheel 79 is mechanically linked to pedals 82 and 84 by means of sprocket 86, chain 88, and sprocket 90. Resistance is offered to rotation of flywheel 79 by means of friction strap 92. A bidirectional motor 94 drives a screw 96 to rotate in either direction. Screw 96 engages with nut 98, which is connected to pivot arm 100. Pivot arm 100 includes a bar 102 that engages with strap 92, as shown.

When bidirectional motor 94 rotates in either of its two directions, pivot arm 100 is caused to pivot in either direction represented by double arrow 104, to either increase or decrease the resistance offered to the rotation of flywheel 79. A strain gauge 106 is connected by means of an appendage 108 to strap 92. Flywheel 79 rotates in the direction of arrow 110. Strain gauge 106 measures the relative resistance offered by strap 92 to flywheel 79 as this resistance changes due to the selective rotation of motor 94. In exercise cycle embodiments, motor 94 is associated with the control system of FIG. 6 in the same manner as motor 72 of FIG. 3.

Figure 5:
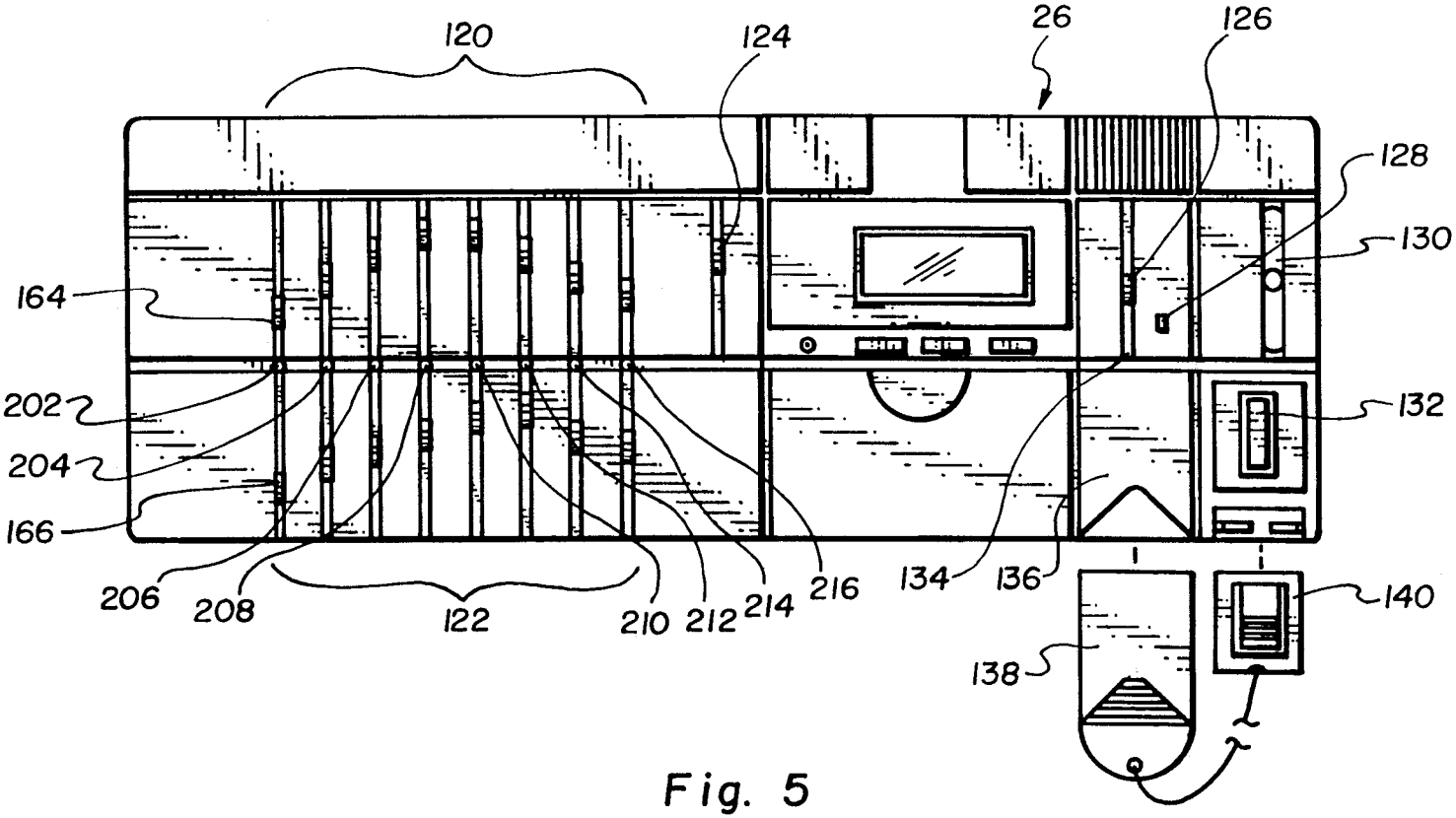
FIG. 5 is a plan view of a control console.

FIG. 5 is a plan view of console 26. Console 26 includes auto speed controls 120, auto incline controls 122, timer control 124, manual speed control 126, program start key 128, incline bubble 130, manual incline control 132, manual mode indicator 134, and, safety card 138, to which is attached clip 140. Pouch 136 is configured to receive card 138 thereby to activate power supply 172.

Figure 6:
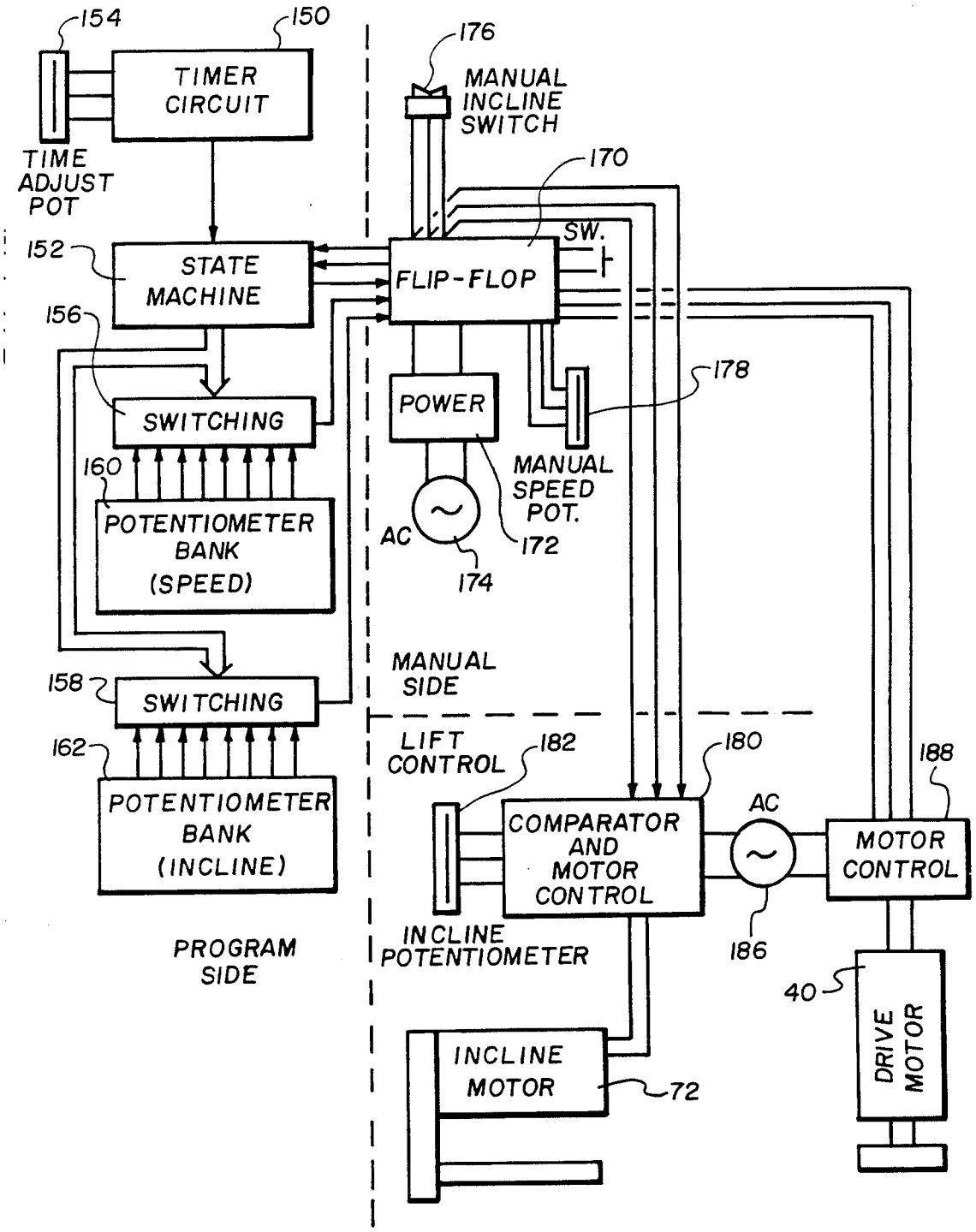
FIG. 6 is a schematic block diagram of a control system.

FIG. 6 is a block schematic diagram of a control system. This control system includes a timer circuit 150 connected to a state machine 152. Timer circuit 150 is connected to and controlled by a time adjustment component 154. Timer circuit 150, based on input from timer adjust 154, provides to state machine 152 an oscillating signal at a selected frequency. State machine 152 then divides the frequency of this signal to provide a plurality of timed steps, which in the illustrated embodiment is disclosed to be eight discrete time steps.

State machine 152 is connected as shown to two switching circuits, switching circuit 156 and switching circuit 158. Switching circuit 156 is connected to eight potentiometers 160, and switching circuit 158 is connected to eight potentiometers 162. Potentiometers 160 are connected to the eight sliders of the auto speed controls 120 (FIG. 5), of which slider 164 is typical. Potentiometers 162 are connected to the eight auto incline controls 122 of which sliding control 166 is typical.

The sliding controls 120 and 122 may be slid up and down by the user to represent relative values. In other words, the user selects eight relative speed values at panel 120, the relative speed corresponding to the relative vertical position of indicators 164 within the console. Similarly, the user selects eight relative values for the incline at panel 122, the vertical positions of sliders 166 representing the relative angles of incline selected.

Switching circuit 156 and switching circuit 158 are connected to a flip-flop circuit 170 Flip-flop 170 is connected to a power supply 172 which is in turn connected to AC line power 174. Switching flip-flop circuit 170 is also connected to a manual incline switch 176. Switching circuit 170 is also connected to a manual speed potentiometer 178.

The major areas of the diagram of FIG. 6 are labeled "program side," on the left side of the block diagram, "manual side," in the upper right-hand corner, and "lift control" in the lower right-hand corner. The lift control includes a comparator circuit 180 connected as shown to flip-flop 170. Comparator circuit 180 is also connected to an incline potentiometer 182 and to the incline motor 72. Comparator circuit 180 is connected to AC power line 186 which is in turn connected to motor controller 188. Flip-flop 170 is also connected to motor controller 188. Motor controller 188 is connected to drive motor 40.

The switching flip-flop circuit 170 switches between the manual control of speed and incline and the "programmed" control of the speed and incline. The comparator circuit 180 compares the values received from the incline potentiometer, representing a relative incline of the treadmill exerciser, to the selected incline at the potentiometers 162. The comparator circuit 180 then controls the incline motor 72 to either increase or decrease the incline, depending on this comparison. The speed selected at the potentiometers 160 is transmitted to motor controller 188 to drive motor 40 at a relative speed corresponding to the relative position of the speed potentiometers 160.

Figure 7:
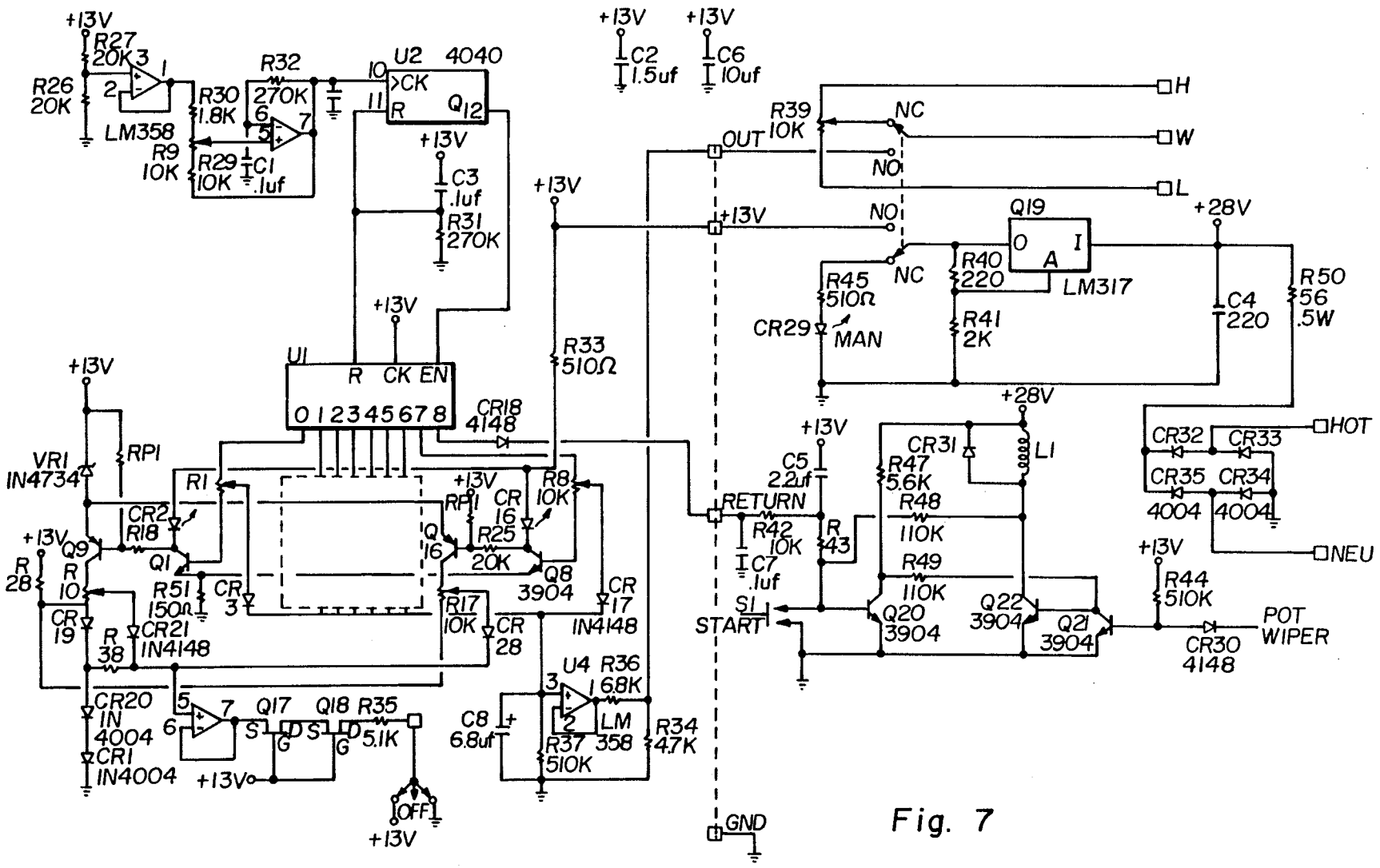
FIG. 7 is a schematic circuit diagram of a control system.

FIG. 7 is a schematic circuit diagram of the control system of FIG. 6. In the upper left hand corner of FIG. 7, the two LM358 operational amplifiers (both labeled U3) and the 4040 counter/divider (U2) provide a timer circuit 150. The LM 358 operational amplifiers provide a relaxation oscillator which feeds an oscillating signal into the clock input of the 4040 counter divider U2. The frequency of the relaxation oscillator is adjusted by the potentiometer R9, which constitutes the time adjust potentiometer 154 of FIG. 6. Potentiometer R9 is a slide potentiometer which is connected to timer control 124 (FIG. 5). Counter/divider (U2) emits at output Q12 an oscillating signal depending upon the resistance set at R9 by means of control 124.

State machine 152 is constituted by the 4017 counter U1. U1 divides the signal it receives from U2 to produce eight equally timed intervals, corresponding to its outputs Q0, Q1, Q2, Q3, Q4, Q5, Q6, and Q7. Each of outputs Q0 through Q7 are connected to identical circuitry, with the illustrated circuitry connected to outputs Q0 and Q7 of U1 being representative. Resistor R1 connected to output Q0 of U1 is associated with the leftmost auto speed control of auto speed controls 164 at panel 120. Identical resistors (not shown) are connected to the other speed controls 164 at panel 120 and in turn to identical circuitry as is resistor R1. The eight controls 164 at panel 120 allow for selection of eight relative values of speed at which belt 22 will operate.

Similarly, resistors RIO through R17 are connected respectively to the eight incline controls 166 of panel 122, to allow the user to select eight relative incline values at which frame 20 will be positioned with respect to the floor surface.

The line labeled "yellow" in the lower left-hand corner of FIG. 7 is connected to the manual incline switch 132, which is, as shown in FIG. 6, a three-way switch. With switch 132 in its center position labeled "off" in FIG. 7, the automatic incline control, discussed infra, is engaged. With the switch in the left position labeled "13 volts," the incline of the treadmill is increased, and with the switch connected to ground, the incline of the treadmill is decreased.

When switch 132 is in its center position, the incline is controlled automatically by the control system. The box in FIG. 7 next to the line labeled "yellow" corresponds to the box labeled "control" in FIG. 8 connected to the line labeled "orange." The signal produced at line "yellow" in FIG. 7 is a signal that controls the relative incline of the treadmill. This signal may also be used to control the relative resistance of a resistance mechanism, such as the resistance mechanism illustrated in FIG. 4 to be connected to an exercise cycle, or, for example, a similar resistance mechanism associated with a rowing machine.

The flip-flop circuitry 170 includes transistors Q20, Q21, and Q22, shown in FIG. 7, along with inductor L1 and the associated resistors and capacitors. Inductor L1 is connected to the switch shown connected to the "green" and "red" outputs. This switch has a normally closed position. When there is no current running through inductor L1, the switch shown associating with the red and green lines, goes to the normally closed position, which places the speed control in a manual mode. In this mode, potentiometer R39, which is connected to slider 126, may be used to control the speed of motor 40, and thus the speed of running track 22. Potentiometer R39 corresponds to manual speed potentiometer 178 of FIG. 6.

Diodes CR32, CR33, CR34, and CR35, the LM317 and the associated resistors, capacitors, and diodes, provide the power supply 172. This power supply reduces 120 volt AC line voltage to approximately 24 volt DC power. The boxes labeled H, W, and L stand for high, wiper and low. These connections are connected to an "off-the-shelf" drive motor 40 that includes an internal motor controller corresponding to motor controller 188 of FIG. 6.

Figure 8:
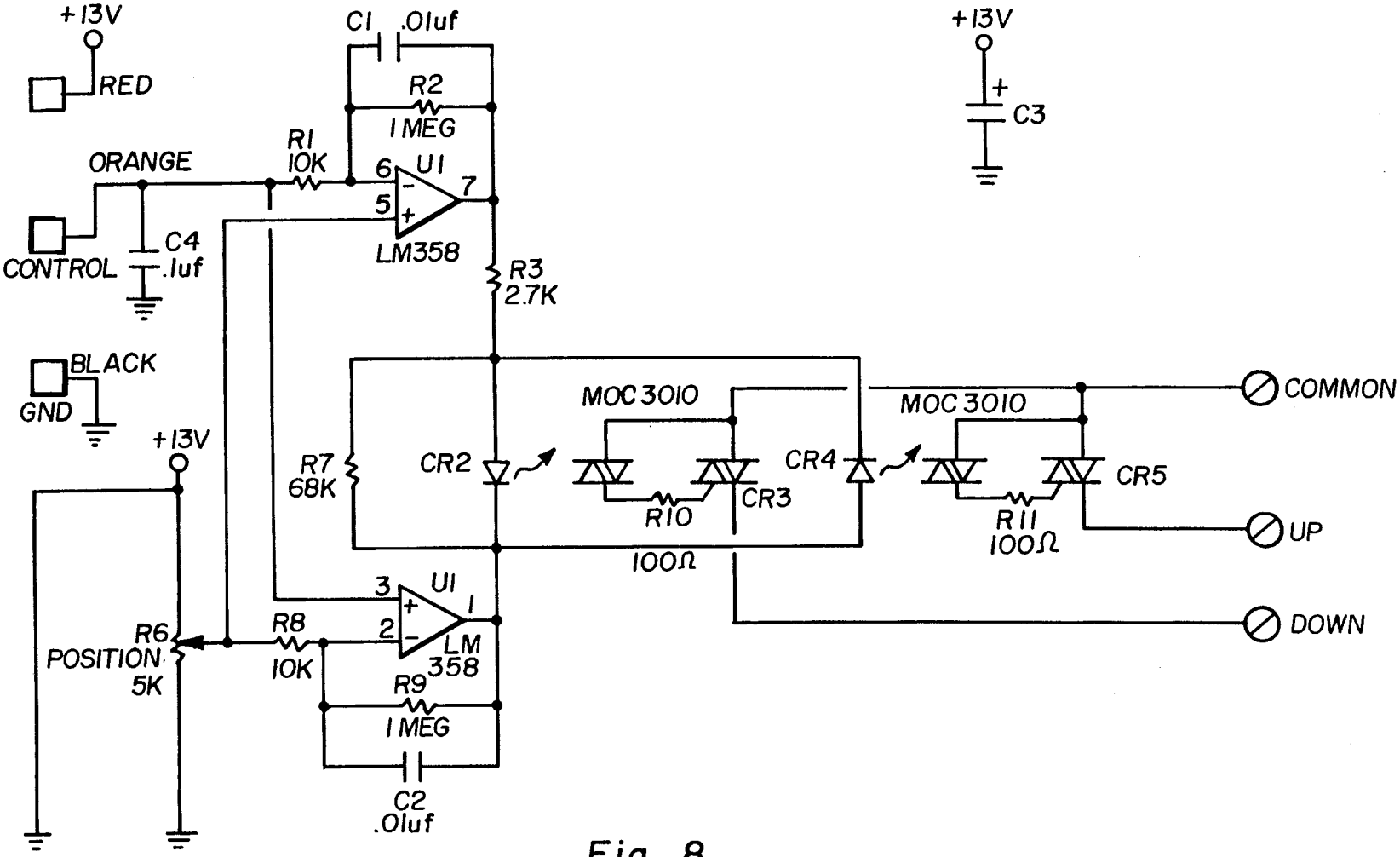
FIG. 8 is a schematic circuit diagram of a comparator circuit.

A comparator circuit is described in reference to FIG. 8. This circuitry controls the incline motor 72 to vary the incline of the treadmill. Alternatively, this comparator circuitry may be used to control the relative resistance of, for example, an exercise cycle by means of, for example, motor 94 and thereby the resistance mechanism illustrated in FIG. 4, or the resistance offered by other exercise machines.

The box labeled "control" is connected to the yellow line in FIG. 7. This control box receives the relative incline signal from the incline slide potentiometer as selected at control panel 122. The user has previously selected eight relative values of incline at panel 122 with the sliders 166.

The state machine of counter/divider U1 engages the system in eight separate timed steps, according to the time selected by the user at slider 124 connected to potentiometer R9. These relative values are compared by the two operational amplifiers LM358 (both labeled U1 in FIG. 8, since they are both taken from a single chip) against the position of a potentiometer R6. Potentiometer R6 is associated with a slider 200 mounted to frame 20 with a sliding piston mounted to leg 62 as shown in FIG. 3. Potentiometer R6 and its associated slider 200 is adapted to provide a resistance corresponding to a relative incline of the exercise machine that may be compared against the relative incline selected by the user at control panel 122.

The LM358 operational amplifiers are connected as shown to the two TRIAC's labeled MOC 3010. The comparator circuit is connected as shown to the "common," "up," and "down" connections of bidirectional motor 72. The circuitry attempts to equalize the signals at outputs 1 and 7 of the LM358's and does this by either increasing or decreasing the incline of the exercise treadmill during the current step being engaged in by the controlling mechanism.

In an exercise cycle application, the relative resistance offered by the exercise cycle to the rotation of the pedals may also be accomplished by a potentiometer coupling such as is represented in FIG. 8. Instead of providing a strain gauge such as strain gauge 106 as shown in FIG. 4, a potentiometer may be connected to a slider engaged with lever arm 100. The relative position of lever arm 100 corresponds to the relative resistance offered by strap 92 to flywheel 79. The common, up, and down connections would be connected to bidirectional motor 94 in FIG. 4. Alternatively, the signal produced by strain gauge 106 may be appropriately manipulated so as to be compared by a comparator circuit such as that shown in FIG. 8 to the position of slide potentiometers in control panel 122. Similar mechanisms may be employed in the resistance mechanism of other exercise machines such as rowing machines or cross-country ski simulators.

In use, a user stands on the treadmill with his feet on pads 30 and 32. He connects clip 140 onto the waistband of his clothing. Safety card 138 is then slid into pouch 136, which then engages the power supply 172 of FIG. 6. Indicator 134 above pouch 136 will then light. This indicator is associated with LED CR29. To turn the power off, the user merely needs to remove safety card 138 from pouch 136.

After the power is turned on, the user may move the manual speed control 126 to its lowest position, which is the reset position. Unless the speed control 126 is moved to its lowest position, the motion of belt 22, i.e., the rotation of motor 40, cannot be started. The user then moves the speed control slowly forward until belt 20 begins to move at slow speed. In this manual mode, the user may move the speed control slowly forward or backward until the belt 22 is moving at the desired speed.

To vary the difficulty of exercise as related to the incline of the treadmill, the user may control the manual incline control 132. To increase the incline of the treadmill, the user presses the top of button 132 until the desired angle is reached. To decrease the incline of the treadmill, the user pushes the bottom of button 132. Bubble indicator 130 indicates the relative incline of the treadmill.

In the "programmable" mode, the user is allowed to select the time that he plans to exercise and to input eight speed and incline settings. The treadmill controller controls the speed and incline of the treadmill automatically for the length of the time set. To input the selected relative speeds, the user moves the timer control slider 124 to its lowest "reset" position. The user then moves timer control 124 for the length of time he plans to exercise, which may be from five to 40 minutes. The user then sets the eight speed control sliders 164 in panel 120 to the eight desired relative speeds.

The user then sets the eight incline sliders 166 in panel 122 at eight relative inclines. The user then presses the program start key 128 to start the program. Button 128 is associated with switch S1 of FIG. 7. Walking belt 22 must be fully stopped before the start key 128 is depressed, or the programming mode will not start. LED indicators are placed in between each of the two adjacent sliders of panel 120 and 122 to indicate the current step that the control system is currently effecting. In other words, a first LED 202 is positioned between the first two sliders to indicate when step 1 is being engaged. A second LED 204 is positioned between the second two sliders to indicate when step 2 is being engaged. Similarly, LEDs 206, 208, 210, 212, 214, and 216 are placed to indicate when steps 3–8 are being engaged, respectively. This array of LED indicators constitutes progress indication means by which a user can determine which step of the program is being implemented.

After the start key is depressed, the first step is engaged in for ⅛ of the total time set. During this time, the control mechanism operates the speed of motor 40 and the incline of the treadmill at relative amounts corresponding to the relative vertical positions of the sliders of panels 120 and 122. The speed selected in panels 120 are totally independent from the inclines selected in panel 122. Thus, a user may select greater difficulties in terms of greater incline and yet lower difficulties in terms of speed at the same time, or he may select low inclines and low speed or high inclines and high speeds, or any variation between these extremes, by adjusting the two values as he desires. Each time step lasts ⅛ of the total time set. When the total time has elapsed, the walking belt 22 comes to a stop, the tread will remain at the last incline setting, and the treadmill control will automatically return to the manual mode.

The auto speed and auto incline controls in panels 120 and 122 can be changed while the program is running, if it is desired. If the user desires to return the treadmill to its manual mode before the program has ended, he simply needs to move the speed control slider 124 away from its "reset" or "program" position.

Reference herein to details of the illustrated embodiment is not intended to limit the scope of the appended claims, which themselves recite those features regarded as important to the invention.

What is claimed:

1. An exercise apparatus, comprising:

a frame;

a moveable member mechanically associated with said frame for repetitive user movement with movement of said moveable member;

adjustment means associated with said moveable member and adapted to selectively vary the difficulty of user movement with movement of said moveable member;

a plurality of indicators associated with said frame proximate each other, said plurality of indicators being moveable with respect to each other by the user to select and to continually visually indicate a sequential set of relative values of said difficulty; and control means operatively linked with said indicators to receive said sequential set of relative values of said difficulty therefrom and with said adjustment means to supply control signals thereto, said control means being adapted to vary said difficulty of user movement with movement of said moveable member in the sequence selected by said user through said indicators.

2. An exercise apparatus according to claim 1 wherein said indicators include slide potentiometers to supply said sequential set of relative values of said difficulty as electrical indicator signals.

3. An exercise apparatus according to claim 1 wherein said control means includes means to select total exercise time and means to divide said total exercise time into a preset number of exercise intervals.

4. An exercise apparatus according to claim 3 further comprising progress indication means connected to said control means, whereby said control means activates said progress indication means to indicate which of said exercise intervals is currently in progress.

5. An exercise apparatus according to claim 1 wherein said frame is a treadmill frame and said moveable member is an endless track associated with said frame.

6. An exercise apparatus according to claim 5 wherein said adjustment means includes a motor linked with said track and adapted to selectively vary the running speed of said track.

7. An exercise apparatus according to claim 5 wherein said adjustment means includes a powered incline system linked with said frame for selectively altering the incline of said frame.

8. An exercise apparatus according to claim 5 wherein said adjustment means includes speed varying means associated with said track for varying the running speed of said track and incline varying means associated with said frame for varying the incline of said frame.

9. A treadmill comprising:

a frame;

an endless track associated with said frame to provide a belt for walking;

drive means connected to said belt to move said belt with respect to said frame;

speed adjustment means associated with said drive means to vary the speed of said belt;

a plurality of indicators proximate each other, each being moveable by a user relative to one another to select and indicate a desired sequence of speeds of said belt; and control means connected to said speed adjustment means to supply control signals to vary the speed of said belt, and said plurality of indicators to receive signals reflective of desired sequence of speeds of said belt, said control means being adapted to energize said speed adjustment means in a chronological sequence of timed steps to actuate said drive means to move said belt at said sequence of speeds corresponding to the positions of said plurality of indicators.

10. A treadmill, comprising:

a frame;

an endless track mounted to said frame to provide a walking belt upon which a user can tread to thereby exercise;

incline adjustment means connected to said frame to vary the angle of incline of said frame with respect to a support surface;

control means connected to said incline adjustment means for selectively controlling said angle of incline; and a plurality of indicators proximate each other and connected to said control means, each said indicator being moveable by said user to a relative position with respect to the others of said indicators as a visual indication of a desired sequence of relative angles of incline; and wherein said control means is responsive to the positions of said indicators to operate said incline adjustment means in said sequence of relative angles of incline corresponding to positions of the indicators.

11. A treadmill, comprising:

a frame for positioning on a support surface;

a moveable track associated with said frame to provide a moveable surface upon which a user can tread to exercise;

drive means connected to said track for driving said track to move at a speed selected from a range of speeds;

incline adjustment means mounted to said frame for varying an incline of said frame relative to said support surface;

control means connected to said drive means to control operation of said drive means and said incline adjustment means; and a plurality of indicators proximate each other and communicatively linked to said control means, each said indicator being moveable by user to a relative position with respect to others of said indicators to provide a visual indication of the operable condition of the drive means and the incline adjustment means;

said control means being adapted to selectively control said drive means and said incline adjustment means to provide an ordered sequence of exercise intervals corresponding to the positions of the indicators.

12. A treadmill according to claim 11 wherein said plurality of indicators are physically arranged to provide a linear physical sequence corresponding to said ordered sequence of exercise intervals.

13. A treadmill according to claim 12 wherein said plurality of indicators includes a first set of indicators corresponding to relative values of speed of said drive means and a second set of indicators corresponding to relative values of angles of said incline adjustment means.

14. A treadmill according to claim 13 wherein said first set of indicators and said second set of indicators are arranged in horizontal rows.

* * * * *

UNITED STATES PATENT AND TRADEMARK OFFICE

CERTIFICATE OF CORRECTION

PATENT NO. : 5,062,632

DATED : 11/5/91

INVENTOR(S) : William T. Dalebout, et al

It is certified that error appears in the above-identified patent and that said Letters Patent is hereby corrected as shown below:

On the title page:

ABSTRACT, line 8, delete "exercise" and add ---exercises---.

Col. 6, line 22, the word "infra" should be underlined.

Col. 4, line 12, the word "infra" should be underlined.

Col. 9, line 68, before "signals" insert ---control---.

Col. 10, line 45, after "by" insert ---said---.

Signed and Sealed this

Eighteenth Day of May, 1993

*Attest:*

Michael K. Kirk

MICHAEL K. KIRK

*Attesting Officer*

*Acting Commissioner of Patents and Trademarks*